US005232162A

United States Patent [19]

Chih

[11] Patent Number: 5,232,162

[45] Date of Patent: Aug. 3, 1993

[54] HAND-HELD WATER SPRAYER WITH ADJUSTABLE SPRAY SETTINGS

[76] Inventor: E-Shun Chih, No. 5, Tian-Yang Section, Lu-Gung Town, Chang-Hau Hsien, Taiwan

[21] Appl. No.: 813,009

[22] Filed: Dec. 24, 1991

[51] Int. Cl.[5] ..... B05B 1/16

[52] U.S. Cl. ..... 239/394; 239/526

[58] Field of Search ..... 239/394, 392, 391, 396, 239/436, 526, 525, 583, 443

[56] References Cited

U.S. PATENT DOCUMENTS

| | | | |
|---|---|---|---|
| 246,673 | 9/1881 | Hall | 239/394 |
| 578,706 | 3/1897 | Adams | 239/394 |
| 4,534,512 | 8/1985 | Chow et al. | 239/394 |
| 4,618,100 | 10/1986 | White et al. | 239/526 |
| 4,666,085 | 5/1987 | Liaw | 239/394 |
| 4,903,897 | 2/1990 | Hayes | 239/394 |

*Primary Examiner*—Andres Kashnikow
*Assistant Examiner*—Karen B. Merritt
*Attorney, Agent, or Firm*—Bacon & Thomas

[57] ABSTRACT

An adjustable spray cup of a water sprayer is provided to adjust the amount of water flowing through a nozzle of the water sprayer to produce variations in the dimensions of the ejected water streams.

1 Claim, 5 Drawing Sheets 261E
261B 261E
261D
261C
8
7
261F
261B 26
264
261D
264
262
263
263
263

261F
261C 261C
263F
262
5
26
263 A
261 D
261 E
263 B1
263 B2
262
263 C1
263 C2
261 F
263 D1
5
263 D2
261 B
262
263 E1
264
263 E2

HAND-HELD WATER SPRAYER WITH ADJUSTABLE SPRAY SETTINGS

BACKGROUND OF THE INVENTION

1. Field of the Invention

The invention is related to an improvement in the structure of an adjustable spray cup of water sprayer. The structural improvement is primarily characterized in that the spray cup is embedded in the main body of the water sprayer to provide a tight, leakproof connection between the spray cup and the main body as the spray cup is rotated to align its nozzle with a water outlet. When the spray cup is connected with the main body, a connector is pinched therebetween such that when the spray cup is rotated to align its nozzle with the water outlet, the waterflow can be adjusted to create variations in the dimensions of the water stream.

2. Description of the Prior Art various types of water sprayers are known in the market. The complexity of the structure is related to the desired number of stream types to be generated. One known type of water sprayer which has a simple structure and yet can generate a variety of stream types is shown in FIG. 1. Water sprayers with this structure have existed in the market for approximately five to six years. The structure generally includes: a handle (1); a main body (11) formed integrally with a connective conduit (12) with an end extending outside the main body (11) and screwed to a press plate (14); a valve opening (15) with a reduced diameter at the front end of the conduit (12) wherein the valve stem (13) can block the valve opening (15) and thus prevent the water pressure inside the conduit (12) from flowing through the water outlet (16), and if the valve stem (13) is pressed backward by the press plate (14), the water pressure inside the conduit (12) from flowing through the through the water outlet (16); and a spray cup (17) having a plurality of circumferentially spaced nozzles (171) (generally four to six nozzles 171)) wherein each of the nozzles (171) is designed to have a different shape (for example: declined triangular shape, linear groove shape, loose shape or foggy shape, and netted shape) to generate various types of water streams according to the water pressure flowing through the nozzle (171). The spray cup (17) is connected to the central column (181) inside the main body (11) by a screw (18) passing through its assembling hole; a locating configuration (19) is mounted within the main body (11); and a locating slot (172) is arranged with a suitable angle on the inner wall of the spray cup (17) so that as the spray cup (17) is rotated, the nozzle (171) of the spray cup (17) can be exactly aligned with the water outlet (16) by merely aligning the locating slot (172) with the locating configuration (19) of the main body (11).

Although the structure of such known water sprayers is simple and can generate a variety of stream types (at least four types), some potential disadvantages exists. In particular, the spray cup (17) is connected with the central column (18) of the main body (11) by a screw (18) passing through an assembling hole to connect the spray cup (17) to the main body (11), however if the screw (18) is screwed too tight, there is no flow permitted while the spray cup (17) is rotating to align its nozzle (171) with the water outlet (16). On the other hand, if the screw (18) is screwed too loose, no tight closure can be achieved as the nozzle (171) of the spray cup (17) is aligning with the water outlet (16), so that the water pressure flowing through the water outlet (16) can not enter the nozzle (171) without leaking.

In addition, with the spray cup (17) being connected to the main body (11) by the screwing of the screw (18), after rotating the spray cup (17) to align its nozzle (171) with the water outlet (16) many times, the screw (18) may loosen so as to not provide a suitable tightening force to prevent water leakage. If the spray cup (17) cannot maintain a longtime tight closure with the water outlet (16), the water sprayer is unusable and will have to be discarded.

Moreover, in this type of water sprayer structure, when the press valve stem (13) of the press plate (14) is positioned such that the water pressure flows through the valve opening (15) and the spray cup (17) is rotated to align the next nozzle (171) with the water outlet (16) in order to change the spraying stream type, a back pressure will be created unless the valve opening (15) is closed before rotating the spray cup. This back pressure causes the water pressure flowing through the water outlet (16) leak around the peripheral of the water outlet.

In addition, in this type of water sprayer, the spraying stream type is confined by the structure and unless the nozzle (171) is absolutely aligned with the water outlet (16), there will be the potential for leakage. Therefore the water pressure flowing through the nozzle (171) is unchangeable during use, and the stream type coming from the netted holes on the spray cup (17) surface cannot be generated.

SUMMARY OF THE INVENTION

The present invention concentrates on improving a spray cup arrangement for water sprayers, which is the primary member for generating various stream types in water sprayers. According to the invention, a spray cup is embedded in the main body of the sprayer to overcome the drawbacks associated with a screw connection. Additionally, a connector is pinched between the spray cup and main body to readily adjust the stream type and to adjust the water pressure through a nozzle in order to effect various flow magnitudes.

DETAILED DESCRIPTION OF THE PREFERRED EMBODIMENT

Figure 1:
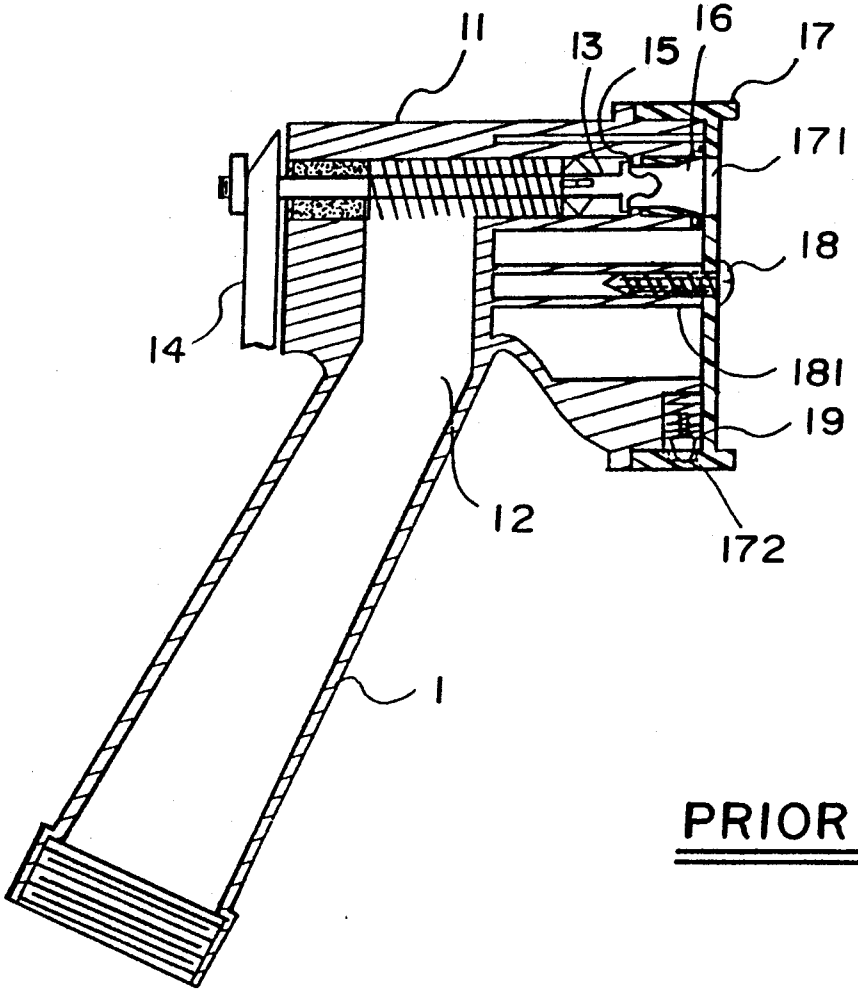
PRIOR ART FIG. 1
FIG. 1 is a cross-sectional view of a conventional water sprayer.
Figures 2, 3:
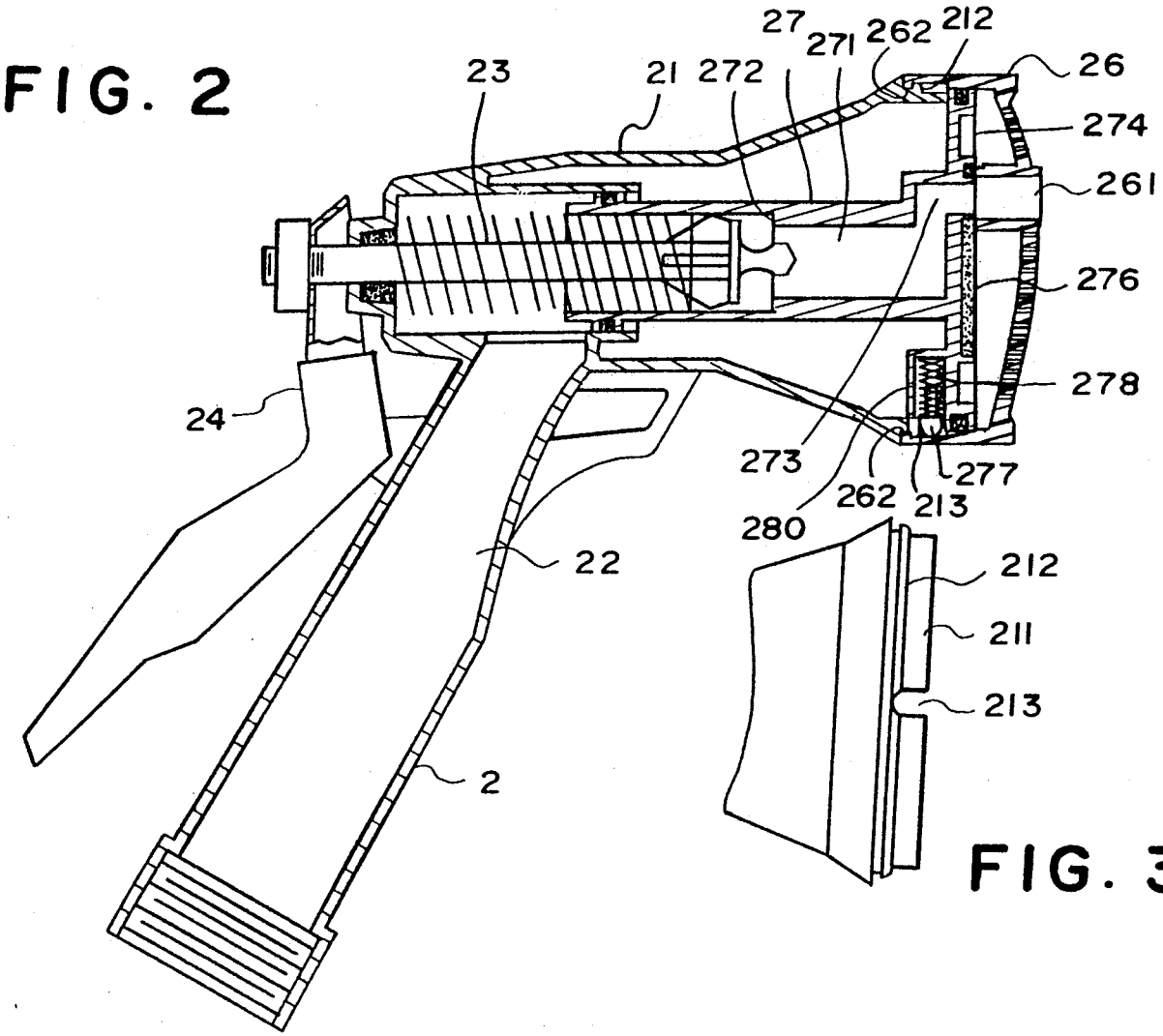
FIG. 2 is a cross-sectional view of the water sprayer according to the present invention.
FIG. 3 is a side view of a portion of the water sprayer of FIG. 2.

With initial reference to FIG. 2, the general structure of the depicted water sprayer includes a handle 2, a main body 21 formed with an integral connective conduit 22, and a valve stem 23 arranged laterally within conduit 22. An end of the valve stem 23 extends to the outer side of the main body 21 and is screwed to a press plate 24. By operating the press plate 24, the valve stem 23 can be shifted forward and backward to operate the opening and closing function of the water pressure within conduit 22.

Figures 4, 5, 6, 7, 8:
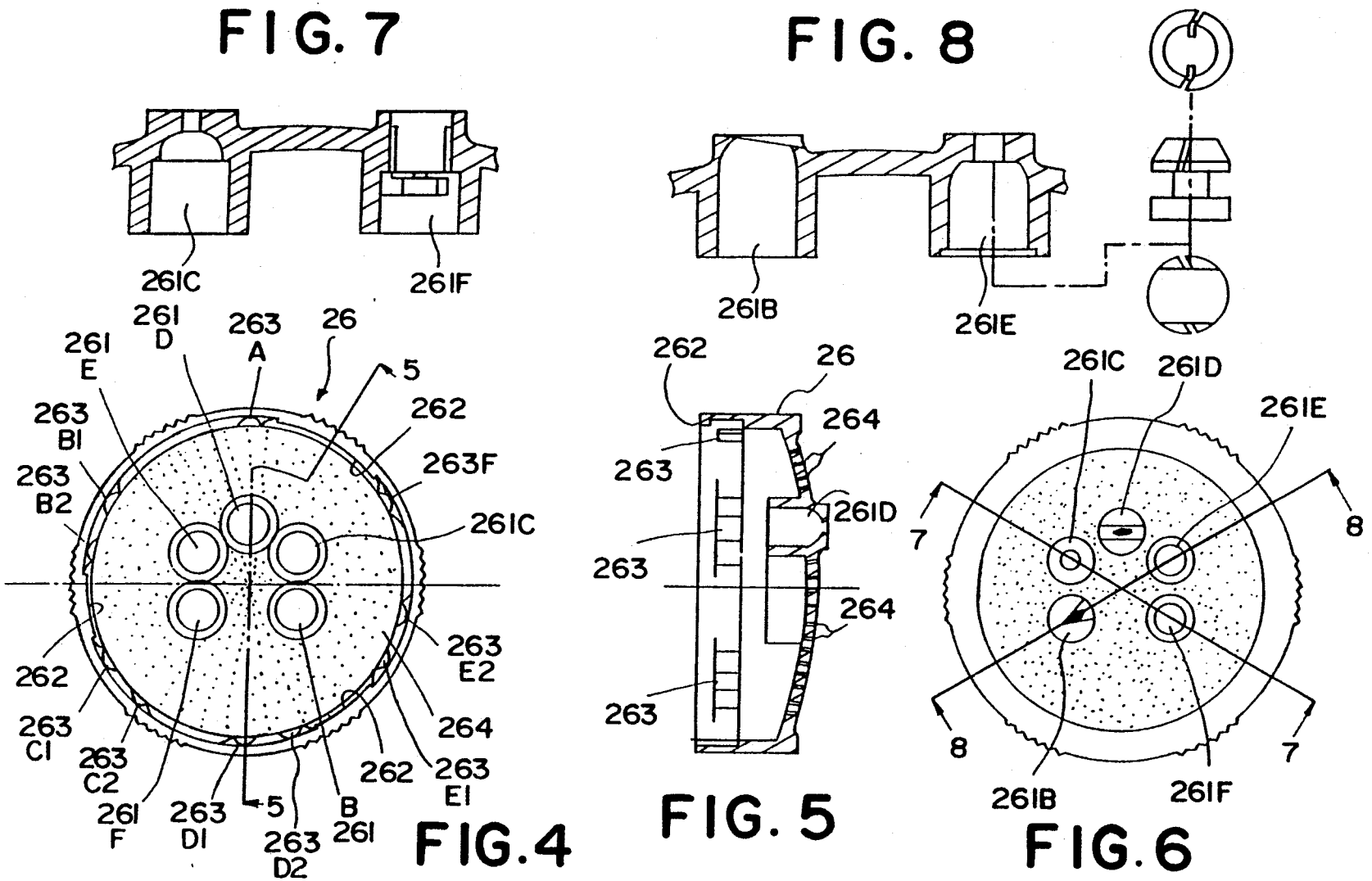
FIG. 4 is a front view of the spray cup according to the present invention.
FIG. 5 is a cross-sectional side view of the spray cup taken along line 5—5 in FIG. 4.
FIG. 6 is a rear view of the spray cup.
FIG. 7 is a cross-sectional view taken along line 7—7 in FIG. 6.
FIG. 8 is a cross-sectional view taken along line 8—8 in FIG. 6.

The water sprayer also includes a plurality of nozzles 261 which are arranged circularly around a spray cup 26 (also see FIG. 4) wherein each nozzle 261 extends inwardly and has a suitable length of wall surface. The shape of the opening rim of the nozzles 261 is the same as that of the prior art and is best shown in FIGS. 5, 7 and 8. The inner wall surface of the opening rim of the spray cup 26 is designed to have a plurality of inwardly protruded lock walls 262 spaced equiangularly and a plurality of locating slots 263 positioned for alignment of the nozzles 261.

Figure 10:
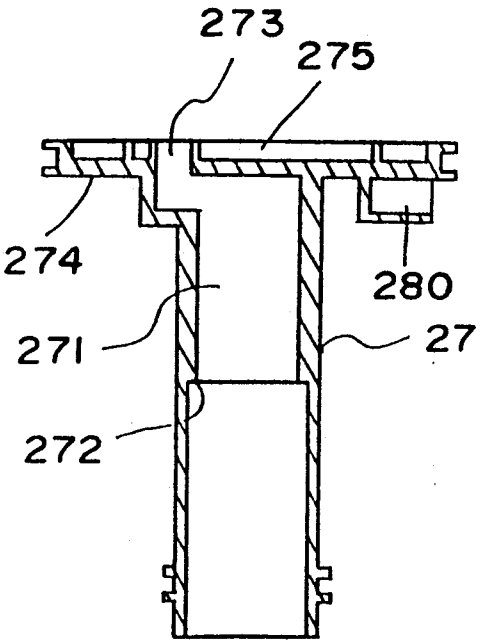
FIG. 10 is a cross-sectional view taken along line 10—10 of the connector shown in FIG. 9.
Figure 9:
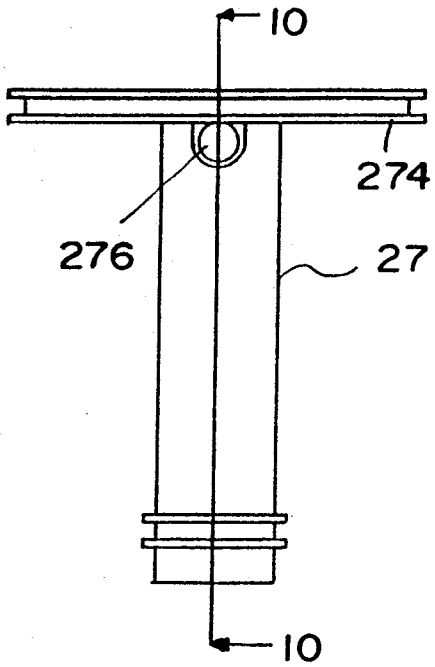
FIG. 9 is a side view of a connector used in the present invention.

As shown in FIGS. 9 and 10, a connector 27 is provided with a conduit 271 therein, wherein the conduit 271 forms a valve opening 272 at a suitable position with a reduced diameter. A water outlet 273 extends from a central line to one side of a partition board 274 wherein the diameter of the partition board 274 is roughly larger than that of the opening rim of an assembling seat 211 of the main body 21 but is substantially equal to the inner diameter of the spray cup 26. The partition board 274 is provided with a packing ring groove 275 to mount a leakproof packing ring 276 (see FIG. 2) and a side of the partition board 274 is provided with a locating seat 280 at the bottom thereof, opposing water outlet 273, to accommodate a locating block 277 and a spring 278 therein.

Moreover, the front edge of the main body 21 includes a spray cup assembling seat 211 (see FIG. 3) An embedding ring 212, which is circular and slantwise arced to one side, is arranged at a suitable position on the assembling seat 211. In addition, a locating slot or hole 213 is positioned right beneath the assembling seat 212.

Assembling of the parts of the water sprayer of the present invention is as follows:

The connector 27 placed into the main body 21 by inserting the end into the conduit 22 of the main body 21, with the partition board 274 of the connector 27 being flat against the opening rim of the assembling seat 211 of the main body 21. If the end of the connector 27 and the side edge of the partition board 274 respectively enter into a leakproof packing ring, any water leaking problem as the connector 27 is connected with the conduit 22 will be overcome. The spray cup 26 is then pushed on the end of main body 21. If there is a water leaking problem between the connector 27 and the spray cup 26 as the connector 27 is pinched by the spray cup 26, such is overcome by means of pushing the spray cup 26 compellingly into the assembling seat 211 of the main body 21, the lock wall 262 of the spray cup 26 can proceed along the slantwise arced curvature of the embedding groove 212 on the assembling seat 211 and effect the embedding connection relationship. The spray cup 26 can thereby be restrictively positioned by the embedding ring 212 and achieve a tightly affixed but freely rotatable status. The nozzle 261 on the spray cup 26 can utilize its inwardly extended wall surface to affix tightly onto the surface of the leakproof packing ring 276 on the partition board 274 of the connector 27. By means of the mutual pinching between the assembling seat 211 of the main body 21 and the inwardly extended wall surface of the nozzle 261 of the spray cup 26, the connector (27) can then be securely positioned therebetween.

Figure 11:
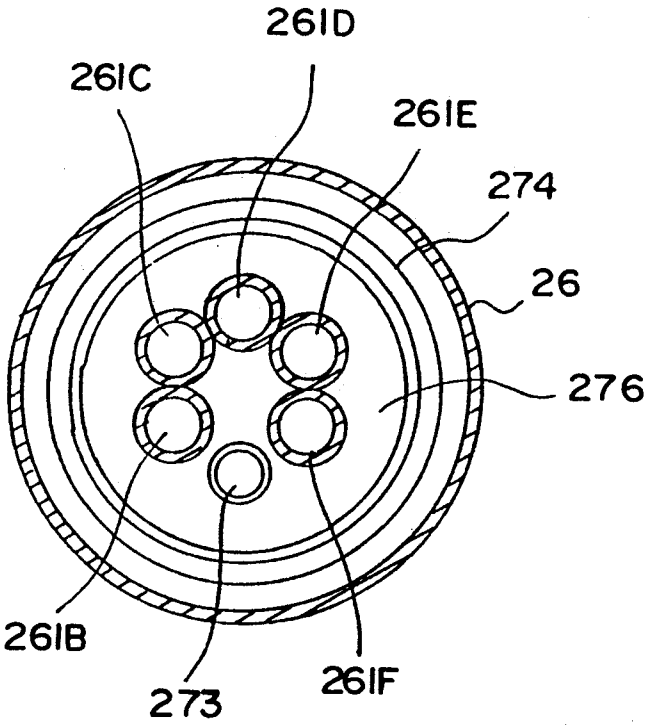
FIG. 11 is a cross-sectional front view depicting the nozzle of the spray cup in an aligned position with a water outlet.

Once assembled, various stream types can be generated by the spray cup 26 as discussed below with reference to FIGS. 11 and 12. In FIG. 11, when the spray cup 26 is rotated to a point (A in FIG. 4) wherein locating slot 263 is aligned with the locating block 277, the water outlet 273 of the connector 27 will not be aligned with one of the nozzles 261 of the spray cup 26. Therefore, the water pressure flowing through the water outlet 273 will enter into the space between the connector 27 and the spray cup 26. Since all of the nozzles 261 on the spray cup 26 will not enter into any nozzle 261 of the spray cup 26. If the surface of the spray cup 26 is wholly distributed with netted holes 264 in advance, the water pressure will be injected from these netted holes 264 to generate a netted stream. This stream generation is due to the forming of a watercourse between the spray cup 26 and the connector 27 according to the present invention.

Figure 12:
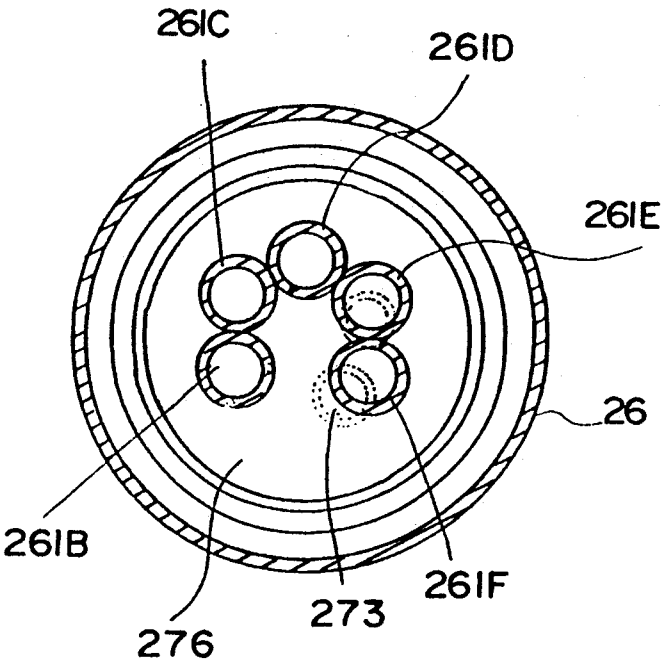
FIG. 12 is a cross-section front view depicting the nozzle of the spray cup in a non-aligned position.

Refer now to FIGS. 4 and 12, wherein as the B-1 point of the locating slot 263 of the spray cup 26 is aligned with the locating block 277 of the locating configuration, the nozzle 261B of the spray cup 26 is then aligned with the water outlet 273 of the connector 27, and the water pressure flowing through the water outlet 273 can thus be ejected from the nozzle 261B without any limitation. As the B-2 point of the locating slot 263 is aligned with the locating block 277 of the locating configuration, half of nozzle 261B is aligned with the water outlet 273 of the connector 27 but the other half is moved onto the leakage packing ring 276. Therefore the water pressure flowing through the water outlet 273 may enter into the nozzle 261B with a halved amount and a stream type with a weaker water pressure is thus obtained at nozzle 261B. By the same reasoning, as the C1 locating slot 263 is aligned with the locating block 277, the stream type with a rather large water pressure may be obtained at nozzle 261C and as the C2 locating slot 263 is aligned with the locating block 277, the stream type with a weaker water pressure may then be obtained at nozzle 261C. Consequently each nozzle 261 may have the adjusting function for various magnitudes of water pressures. This added function is due to the connector 27 provided between the spray cup 26 and the conduit 22.

I claim:

1. An adjustable water sprayer comprising:

a substantially hollow main body having a front edge provided with an assembling seat, said assembly seat including an annular, slantwise arched embedding ring;

a spray cup having a spray surface, provided with a plurality of netted holes and a plurality of spaced nozzles, and an inner wall surface, said inner wall surface terminating in an annular opening rim provided with a plurality of circumferentially and substantially equally spaced lock walls that protrude radially inwardly therefrom, said inner wall surface further including a plurality of locating slots spaced thereabout, each of said locating slots being positioned a predetermined distance and angle with respect to a respective one of said spaced nozzles;

a spray cup having a spray surface, provided with a plurality of netted holes and a plurality of spaced nozzles, and an inner wall surface, said inner wall surface terminating in an annular opening rim provided with a plurality of circumferentially and substantially equally spaced lock walls that protrude radially inwardly therefrom, said inner wall surface further including a plurality of locating slots spaced thereabout, each of said locating slots being positioned a predetermined distance and angle with respect to a respective one of said spaced nozzles;

a connector member provided with a conduit terminating in a radially extending, annular partition board, said conduit defining a longitudinal central axis and including a reduced diameter valve opening and a water outlet, said water outlet opening into said partition board at a position radially offset from the longitudinal central axis of said conduit, said partition board having a diameter substantially equal to the diameter of the inner wall surface of said spray cup and being provided with a packing ring groove about said water outlet; and a packing ring positioned in said packing ring groove, wherein said connector member is received within said main body with said partition board abutting the front edge of said main body and said spray cup is connected to said main body by passing the lock walls through the embedding ring and pinching said connector member therebetween such that rotation of said spray cup with respect to said main body and connector member enables water flowing through said conduit and out said water outlet to flow through selective ones of said plurality of netted holes and spaced nozzles at various water pressures.

* * * * *